US009459639B2

(12) United States Patent
Kasai

(10) Patent No.: US 9,459,639 B2
(45) Date of Patent: Oct. 4, 2016

(54) POWER SUPPLY CIRCUIT WITH CONTROL UNIT

(71) Applicant: KABUSHIKI KAISHA TOSHIBA, Tokyo (JP)

(72) Inventor: Kei Kasai, Toshima Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 14/634,279

(22) Filed: Feb. 27, 2015

(65) Prior Publication Data

US 2016/0026197 A1 Jan. 28, 2016

(30) Foreign Application Priority Data

Jul. 23, 2014 (JP) ..... 2014-150161

(51) Int. Cl.
*G05F 1/563* (2006.01)
*G05F 1/56* (2006.01)

(52) U.S. Cl.
CPC ..... *G05F 1/56* (2013.01)

(58) Field of Classification Search
CPC ..... G05F 3/16
USPC ..... 323/271, 273, 274, 275, 276, 277, 278, 323/279, 282, 284, 285, 312, 313, 315, 316
See application file for complete search history.

(56) References Cited

U.S. PATENT DOCUMENTS 6,222,403 B1 4/2001 Mitsuda
6,366,474 B1 * 4/2002 Gucyski ..... 363/20
7,741,894 B2 6/2010 Kojima
7,821,328 B2 * 10/2010 Hoque et al. ..... 327/536
2008/0203991 A1 * 8/2008 Williams ..... 323/288
2010/0264957 A1 10/2010 Tamaoka
2012/0062198 A1 * 3/2012 Takano et al. ..... 323/282
2012/0229116 A1 * 9/2012 Namai et al. ..... 323/311
2012/0268089 A1 * 10/2012 Kasai ..... 323/271
2012/0313600 A1 * 12/2012 Saito et al. ..... 323/282
2013/0038307 A1 * 2/2013 Saito et al. ..... 323/283
2013/0063121 A1 * 3/2013 Kasai ..... 323/311
2014/0062431 A1 * 3/2014 Yanase et al. ..... 323/271

FOREIGN PATENT DOCUMENTS

JP 3152204 B2 4/2001
JP 2007288667 A 11/2007

* cited by examiner

*Primary Examiner* — Adolf Berhane
*Assistant Examiner* — Nusrat Quddus
(74) *Attorney, Agent, or Firm* — Patterson & Sheridan, LLP

(57) ABSTRACT

According to one embodiment, a power supply circuit includes a load switch, a switching control unit, a first control unit, and a second control unit. The load switch is connected to a power supply and switches between an ON state connecting the power supply to a load and an OFF state disconnecting the power supply from the load. The switching control unit outputs a first signal for controlling switching of the load switch between the ON and OFF states. The first control unit increases an output voltage of the load switch in a steady manner over a predetermined period of time when the load switch is switched to the ON state in response to the first signal. The second control unit causes a charging current to flow to the load switch after the first signal is output from the switching control unit.

17 Claims, 5 Drawing Sheets

(COMPARISON EXAMPLE)

POWER SUPPLY CIRCUIT WITH CONTROL UNIT

CROSS-REFERENCE TO RELATED APPLICATION

This application is based upon and claims the benefit of priority from Japanese Patent Application No. 2014-150161, filed Jul. 23, 2014, the entire contents of which are incorporated herein by reference.

FIELD

Embodiments described herein relate generally to a power supply circuit.

BACKGROUND

A power supply circuit which is used in electronic equipment, or the like, is connected to a load through a load switch. When a capacitor is included in the load, a rush current flows when switching is excessive. It is necessary to suppress the surge in current since there is a concern that such current may cause the load switch to break down when a current value thereof is large.

Therefore, in the related art, there is technology for gently changing a switching control voltage of the load switch so that the slope of a rising output voltage is controlled. However, in such a case, the load switch is not turned on until the switching control voltage of the load switch reaches the threshold voltage of the load switch. For this reason, there is a problem in that a delay occurs from an input of a control signal, which instructs the load switch to be turned on, to a start of the increasing output voltage.

DETAILED DESCRIPTION

Figure 1:
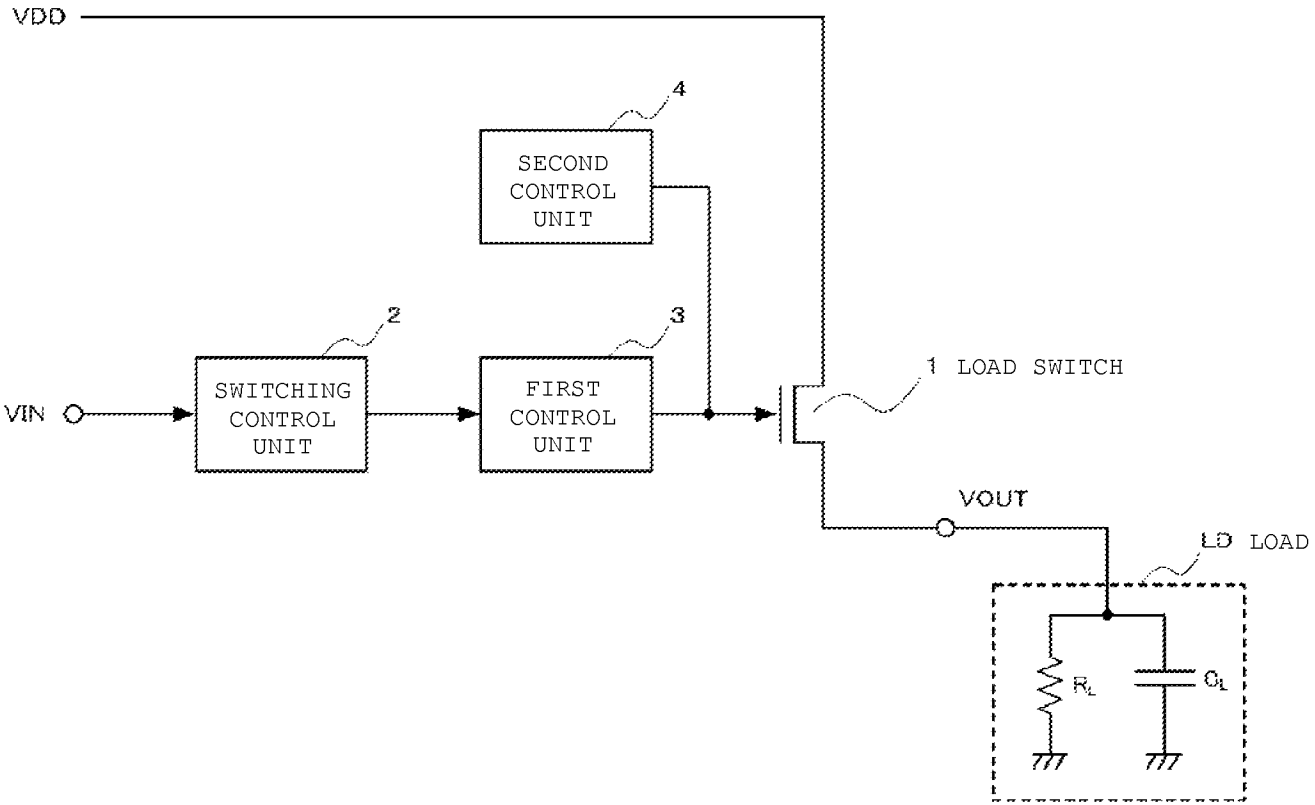
FIG. 1 is a block diagram which illustrates a power supply circuit according to an embodiment.

An object of the disclosure is to provide a power supply circuit that reduces switching delays when a control voltage of a load switch is gently changed.

According to an embodiment, a power supply circuit includes a load switch, a switching control unit, a first control unit, and a second control unit. The load switch is connected to a power supply and configured to switch between an ON state connecting the power supply to a load and an OFF state disconnecting the power supply from the load. The switching control unit is configured to output a first signal for controlling switching of the load switch between the ON and OFF states. The first control unit is configured to increase an output voltage of the load switch in a steady manner over a predetermined period of time when the load switch is switched to the ON state in response to the first signal. The second control unit is configured to cause a charging current to flow to the load switch after the first signal is output from the switching control unit.

Hereinafter, an embodiment of the present disclosure is described with reference to drawings. In addition, in the figure, the same or corresponding portions are given the same reference numerals, and descriptions thereof are not repeated.

Embodiment

FIG. 1 is a block diagram which illustrates a configuration example of a power supply circuit according to an embodiment.

The power supply circuit according to the embodiment includes a load switch 1 which is disposed between a power supply VDD and a load LD and switches ON and OFF power supplied to the load LD, a switching control unit 2 which generates a first signal for controlling the load switch 1, a first control unit 3 which receives the first signal, and gradually raises an output voltage after turning on of the load switch 1, and a second control unit 4 which turns on the load switch 1 by causing a charging current to flow to the parasitic capacitance of the load switch 1 after generation of the first signal.

The load switch 1 performs switching ON and OFF of a connection between the load LD and the power supply VDD. When the load switch 1 is turned on, the power supply VDD is supplied to the load LD, and when the load switch 1 is turned off, the power supply VDD is not supplied to the load LD.

FIG. 1 illustrates an example in which an MOS transistor is used as the load switch 1. In addition, the load LD includes a load resistance RL and a load capacitance CL.

A characteristic of the power supply circuit according to the embodiment is that the circuit includes the second control unit 4.

Figure 2:
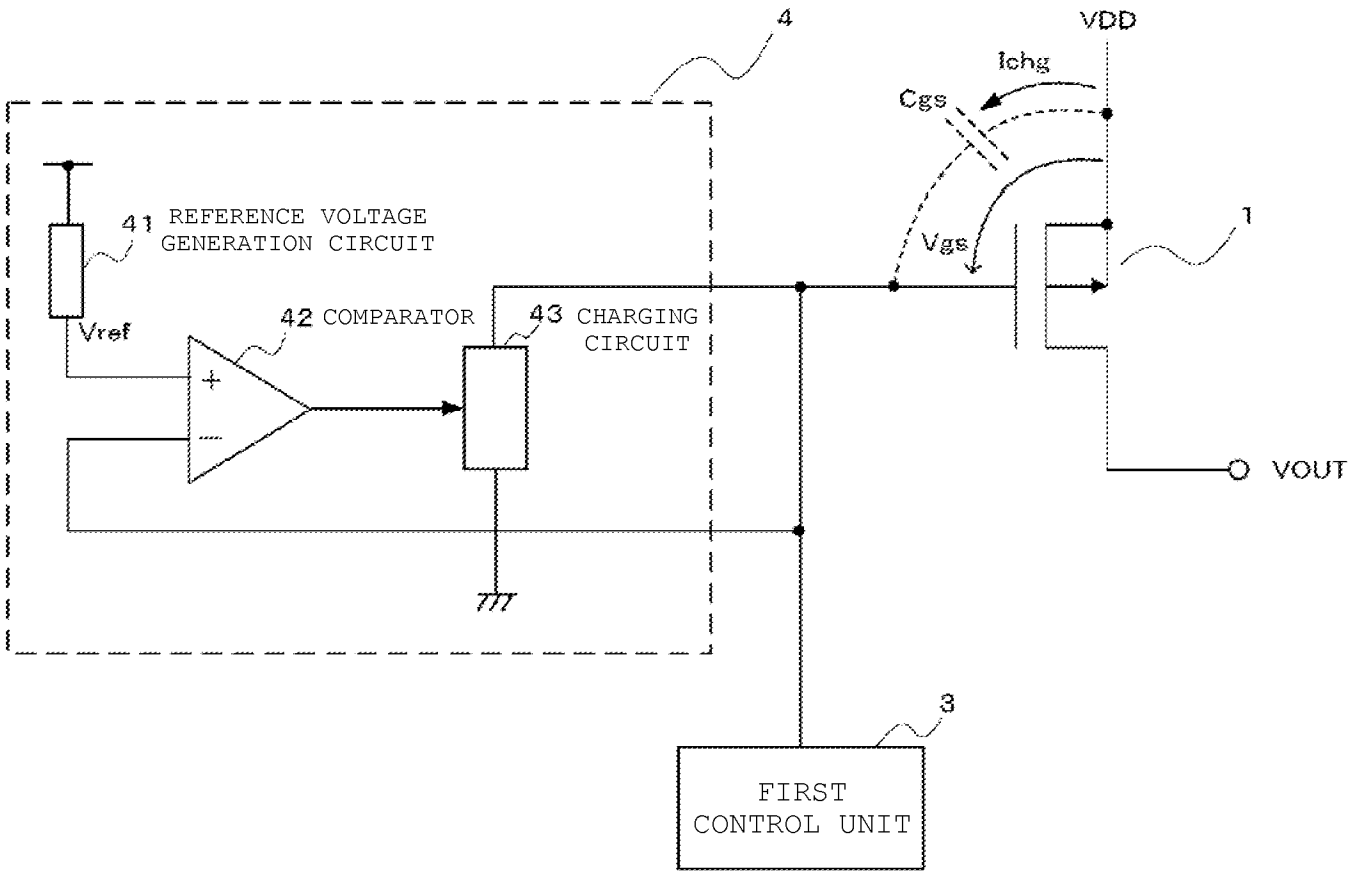
FIG. 2 is a block diagram which illustrates a conduction start acceleration unit depicted in FIG. 1.

FIG. 2 is a block diagram which illustrates an example of an internal configuration of the second control unit 4. In addition, in the example illustrated in FIG. 2, the MOS transistor which is used as the load switch 1 is a P-channel type MOS transistor (PMOS transistor).

The second control unit 4, which is illustrated in FIG. 2, includes a reference voltage generation circuit 41 which generates a reference voltage Vref, a comparator 42 which compares a gate-source voltage Vgs of the PMOS transistor being used as the load switch 1 to the reference voltage Vref, and a charging circuit 43 which is controlled by an output signal of the comparator 42 to cause a charging current Ichg to flow in a parasitic capacitance Cgs which is formed between the gate and source of the PMOS transistor.

Operation of the second control unit 4, in particular, operation when the switching control unit 2 instructs the load switch 1 to switch from OFF to ON is next described.

In addition, the description assumes that the reference voltage Vref is set to be equal to a threshold voltage Vth of the PMOS transistor, the load switch 1. That is, in this case, the reference voltage Vref is a negative potential ($Vref=Vth<0$).

In addition, the charging circuit 43 is set to cause the charging current Ichg to flow to the parasitic capacitance Cgs only when an output signal of the comparator 42 is '0'.

The gate-source voltage Vgs of the PMOS transistor which is the load switch 1 becomes approximately 0 V ($Vgs\cong 0$ V) immediately after an instruction from the switching control unit 2 to switch from OFF to ON.

Accordingly, at this time, '0' is output from the comparator 42 since it is the case that $Vgs>Vref$.

When the output from the comparator 42 is '0', the charging circuit 43 lowers the gate voltage of the PMOS transistor which is the load switch 1, and causes the charging current Ichg to flow to the parasitic capacitance Cgs from the power supply VDD. In this manner, the gate-source voltage Vgs of the PMOS transistor is rapidly changed to a negative potential.

When the gate-source voltage Vgs of the PMOS transistor reaches the threshold voltage Vth (Vgs=Vth), the output signal of the comparator 42 is changed to '1'.

When the output of the comparator 42 becomes '1', the charging circuit 43 stops the flow of the charging current Ichg.

In this manner, according to the embodiment, due to the operation of the second control unit 4, it is possible to make the gate-source voltage Vgs of the PMOS transistor which is the load switch 1 rapidly change to the threshold voltage Vth in response to a switching instruction from OFF to ON.

In this manner, the PMOS transistor which is the load switch 1 is switched to the ON state without delay.

On the other hand, after the ON state, an output voltage VOUT of the load switch 1 is gently changed due to a control of the first control unit 3.

Figure 3:
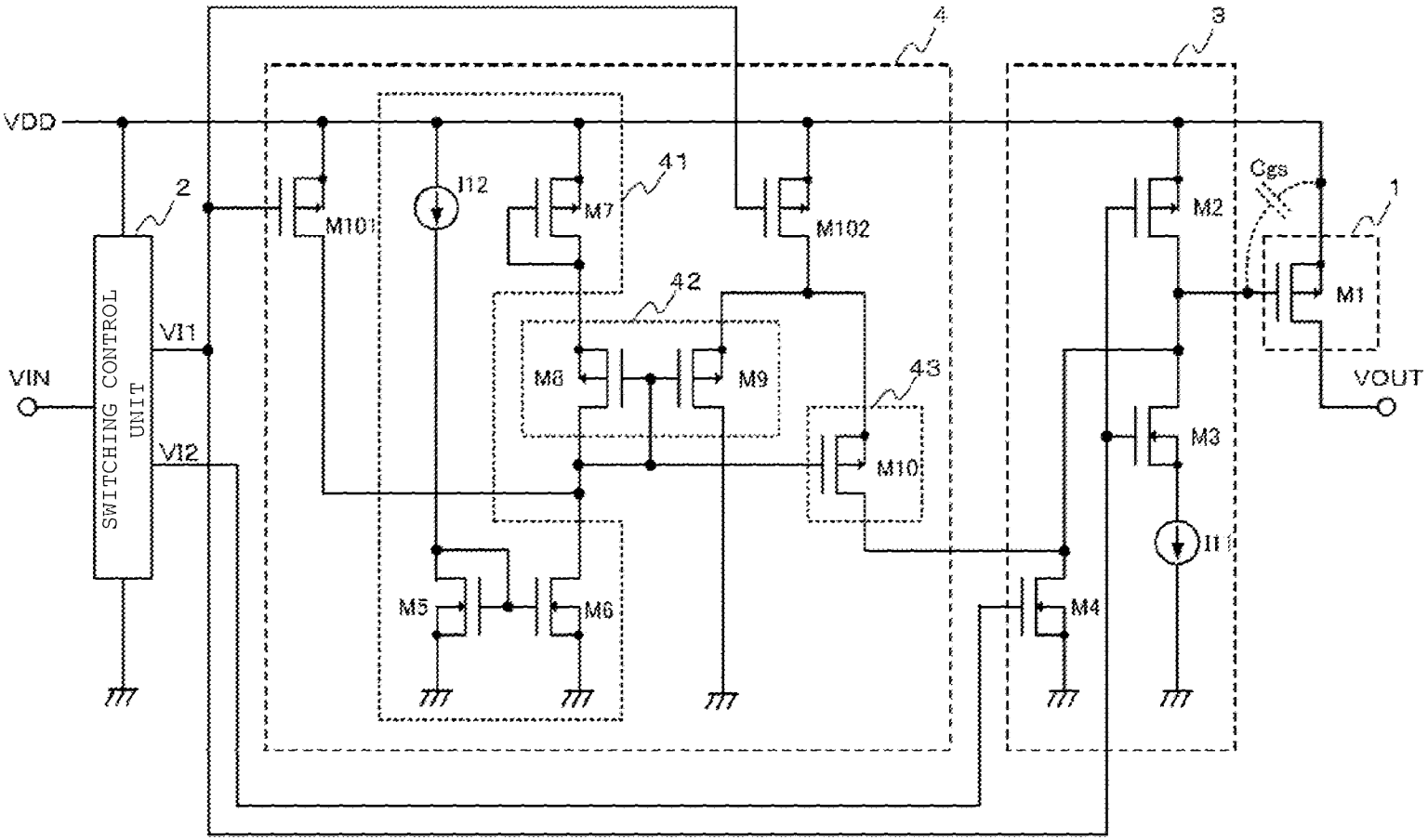
FIG. 3 is a circuit diagram of a specific example of the power supply circuit according to the embodiment.

FIG. 3 is a circuit diagram which illustrates a specific configuration example when the power supply circuit according to the embodiment is configured using a MOS transistor. FIG. 3 is an example when the load switch 1 is implemented with a PMOS transistor.

In the example illustrated in FIG. 3, a PMOS transistor M1 couples the supply VDD to the Vout terminal.

The switching control unit 2 transmits a switching control signal VI1 and a switching control signal VI2 which are generated based on an input switching control signal VIN.

The first control unit 3 includes a PMOS transistor M2 and an NMOS transistor M3 which have an inverter configuration, a constant current source I11 which is connected between a source terminal of the NMOS transistor M3 and a ground terminal, and a NMOS transistor M4 which is connected between a gate terminal of the PMOS transistor M1 and the ground terminal.

The switching control signal VI1 commonly drives the gate terminals of the PMOS transistor M2 and the NMOS transistor M3, and the common drain terminal of the pair drives the gate terminal of the PMOS transistor M1.

In addition, the switching control signal VI2 is sent to the gate terminal of the NMOS transistor M4.

The second control unit 4 includes the reference voltage generation circuit 41, the comparator 42, and the charging circuit 43.

The reference voltage generation circuit 41 includes a constant current source I12, an NMOS transistor M5 in which a drain terminal and a gate terminal are connected to the constant current source I12, an NMOS transistor M6 which configures the NMOS transistor M5 and NMOS transistor M6 into a current mirror circuit, and a PMOS transistor M7 which is biased with the current value set by the constant current source I12 through the above-described current mirror circuit.

In the PMOS transistor M7, a source terminal is connected to the power supply VDD, and a gate terminal is connected to a drain terminal. A gate-source voltage Vgs (M7) of the PMOS transistor M7 serves as the reference voltage Vref of the comparator 42.

Here, as the reference voltage, a value corresponding to the threshold voltage Vth (M1) of the PMOS transistor M1, which is the load switch 1, is set.

The comparator 42 is implemented as a pair of PMOS transistors, PMOS transistor M8 and PMOS transistor M9. In addition, the charging circuit 43 is implemented as a PMOS transistor M10.

In the PMOS transistor M8, the source terminal is connected to the drain terminal of the PMOS transistor M7, and the drain terminal and the gate terminal are connected to the drain terminal of the NMOS transistor M6.

In the PMOS transistor M9, the source terminal is connected to the source terminal of the PMOS transistor M10, the gate terminal is connected to the drain terminal of the PMOS transistor M8, and the drain terminal is connected to a ground terminal.

In the comparator 42, a source potential of the PMOS transistor M8 is compared with a source potential of the PMOS transistor M9.

In the PMOS transistor M10 which forms the charging circuit 43, the source terminal is connected to the source terminal of the PMOS transistor M9, the gate terminal is connected to the drain terminal of the PMOS transistor M8, and the drain terminal is connected to the gate terminal of the PMOS transistor M1 which is the load switch 1.

In this manner, the comparator 42 turns on the PMOS transistor M10 of the charging circuit 43 when the source potential of the PMOS transistor M9 is higher than the source potential of the PMOS transistor M8.

In addition, PMOS transistors M101 and M102 are circuits which are provided so that the comparator 42 is disabled when the load switch 1 is turned off. That is, when the switching control signal VI1 is '0', and the load switch 1 is turned off, the PMOS transistors M101 and M102 are turned on, and the gate terminals and the source terminals of the PMOS transistors M9 and M10 are all set to the VDD level. For this reason, the PMOS transistors M9 and M10 are turned off, and the comparator 42 is disabled. Thus, it is possible to prevent the comparator 42 from operating when the load switch 1 is turned off.

Figures 4A, 4B, 4C:
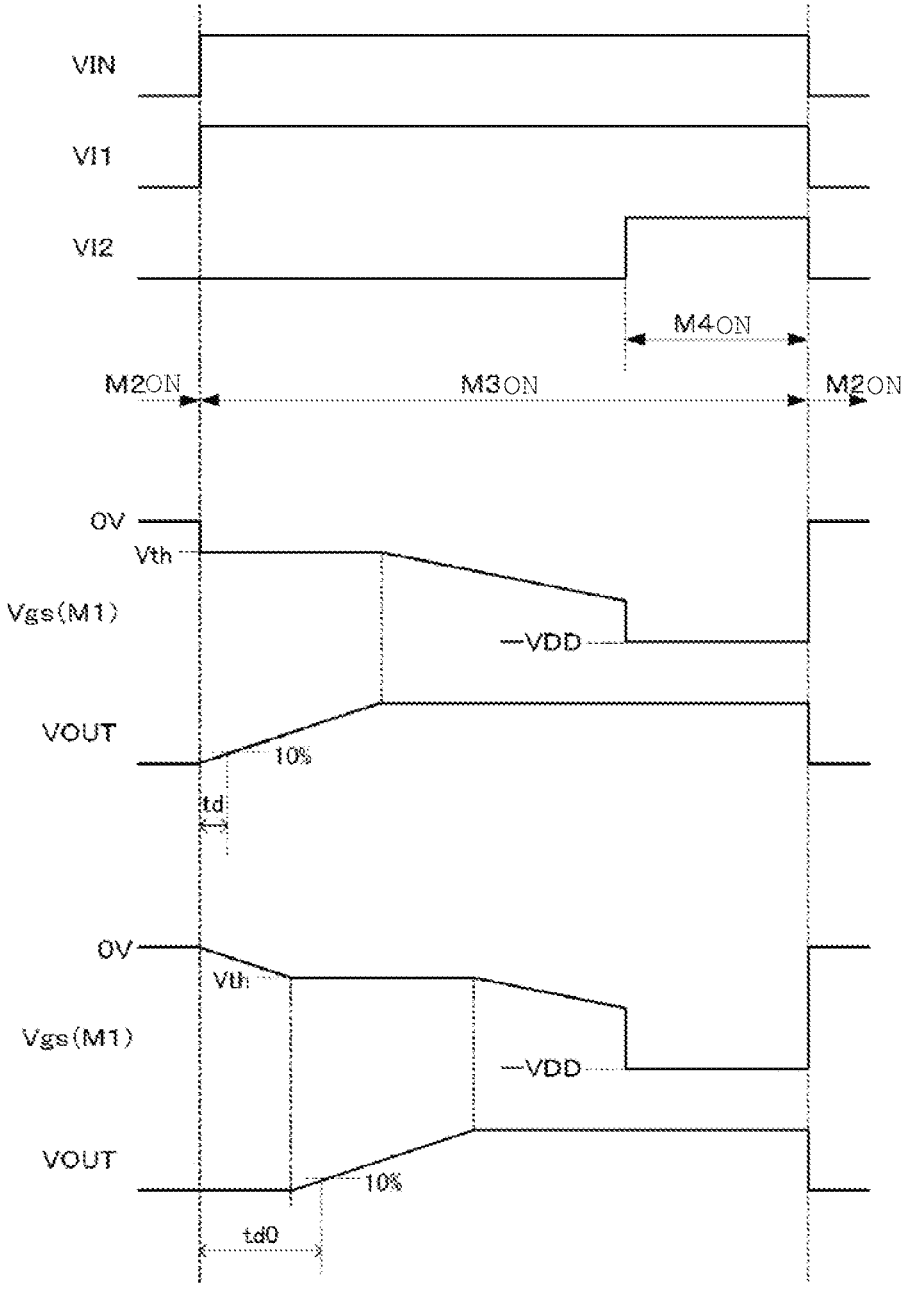
FIGS. 4A through 4C are waveform charts which describe operations of the power supply circuit according to the embodiment.

Next, operation of a circuit which is illustrated in FIG. 3 is described using a waveform chart illustrated in FIGS. 4A through 4C.

FIG. 4A illustrates the relationship between the switching control signal VIN, which is the input to the switching control unit 2, and the switching control signals VI1 and VI2, which are the outputs from the switching control unit 2.

The switching control signal VI1 is a signal which is subjected to the same change as the switching control signal VIN, and the switching control signal VI2 is a signal which becomes '1' only in the last period of the switching control signal VIN in which the signal is '1' due to the switching control unit 2.

In the first control unit 3, the PMOS transistor M2 is turned on, and the NMOS transistor M3 is turned off when the switching control signal VI1 is '0'. In addition, at this time, the NMOS transistor M4 is also turned off since the switching control signal VI2 is also '0'.

In this manner, the gate voltage of the PMOS transistor M1 becomes VDD, and the PMOS transistor M1, which is the load switch 1, is turned off.

To turn on the load switch 1, first, the switching control signal VI1 is changed to '1'. In this manner, the state is changed so that the PMOS transistor M2 is turned off, and the NMOS transistor M3 is turned on. In contrast to this, the NMOS transistor M4 stays in the OFF state, since the switching control signal VI2 is still '0'.

The gate-source voltage Vgs (M1) of the PMOS transistor M1 is approximately 0 V immediately after the PMOS transistor M2 is turned off, and the NMOS transistor M3 is turned on. For this reason, the PMOS transistor M10 of the charging circuit 43 is turned on, and a current flows from the gate terminal of the PMOS transistor M1 to the ground terminal through the PMOS transistor M9 of the comparator 42.

In this manner, the gate-source voltage Vgs (M1) of the PMOS transistor M1 decreases, and a charging current flows in the parasitic capacitance Cgs between the gate and source.

When the gate-source voltage Vgs (M1) of the PMOS transistor M1 reaches the reference voltage Vref of the comparator 42, that is, the threshold voltage Vth (M1) thereafter, the comparator 42 turns off the PMOS transistor M10 of the charging circuit 43. In this manner, the charging current does not flow to the parasitic capacitance Cgs of the PMOS transistor M1.

The gate-source voltage Vgs (M1) of the PMOS transistor M1 is changed slowly due to a control of the first control unit 3 after turning off the PMOS transistor M10 of the charging circuit 43. In this manner, the output voltage VOUT is also slowly changed.

In FIG. 4B illustrates change in the gate-source voltage Vgs (M1) of the PMOS transistor M1 and the output voltage VOUT.

The gate-source voltage Vgs (M1) of the PMOS transistor M1 is rapidly changed to the threshold voltage Vth (M1) when the switching control signal VIN is changed from '0' to '1'.

The output voltage VOUT starts to rise after the gate-source voltage Vgs (M1) of the PMOS transistor M1 reaches the threshold voltage Vth (M1). After reaching the threshold voltage, the output voltage VOUT slowly rises due to a control of the first control unit 3.

The time in which the output voltage VOUT rises up to 10% of the power supply voltage after the change of the switching control signal VIN is the output delay time td, according to the embodiment illustrated in FIG. 4B.

FIG. 4C illustrates as a comparison example for illustrating an effect of the second control unit 4 according to the embodiment, the change in gate-source voltage Vgs (M1) and the change in output voltage VOUT, when the gate voltage of the PMOS transistor M1 is controlled by only the first control unit 3.

In the comparison example illustrated in FIG. 4C, when the switching control signal VIN is changed from '0' to '1', the gate-source voltage Vgs (M1) of the PMOS transistor M1 is slowly changed, since the gate-source voltage is controlled by the first control unit 3.

For this reason, it takes time until the gate-source voltage Vgs (M1) of the PMOS transistor M1 reaches the threshold voltage Vth (M1).

In the output voltage VOUT, the output delay time in the comparison example becomes td0, since the gate-source voltage Vgs (M1) of the PMOS transistor M1 starts to rise only after reaching the threshold voltage Vth (M1).

The td0 is a considerably larger value compared to the output delay time td according to the embodiment which is illustrated in FIG. 4B.

In other words, according to the embodiment, even when the output voltage VOUT is controlled so as to slowly rise, it is possible to greatly reduce the output delay time of the output voltage VOUT.

In addition, as illustrated in FIG. 4B, the switching control signal VI2 is changed from '0' to '1' after the rising of the output voltage VOUT is ended. In this manner, the NMOS transistor M4 is turned on. When the NMOS transistor M4 is turned on, the PMOS transistor M1 is latched on and thus prevented from being turned off due to a fluctuation in power supply, or the like.

In addition, according to the embodiment, since the load switch 1 and the MOS transistor which generates the reference voltage Vref have the same conductivity type, the reference voltage Vref by follows the temperature fluctuation in the threshold voltage Vth of the load switch 1. In this manner, it is possible to reduce temperature dependence of the output delay time td.

In addition, by changing a gate-source voltage Vgs (M7), that is, the reference voltage Vref, by adjusting a dimension of the PMOS transistor M7, it is possible to change the time at which the output voltage VOUT starts rising, and to adjust a value of the output delay time td.

Figure 5:
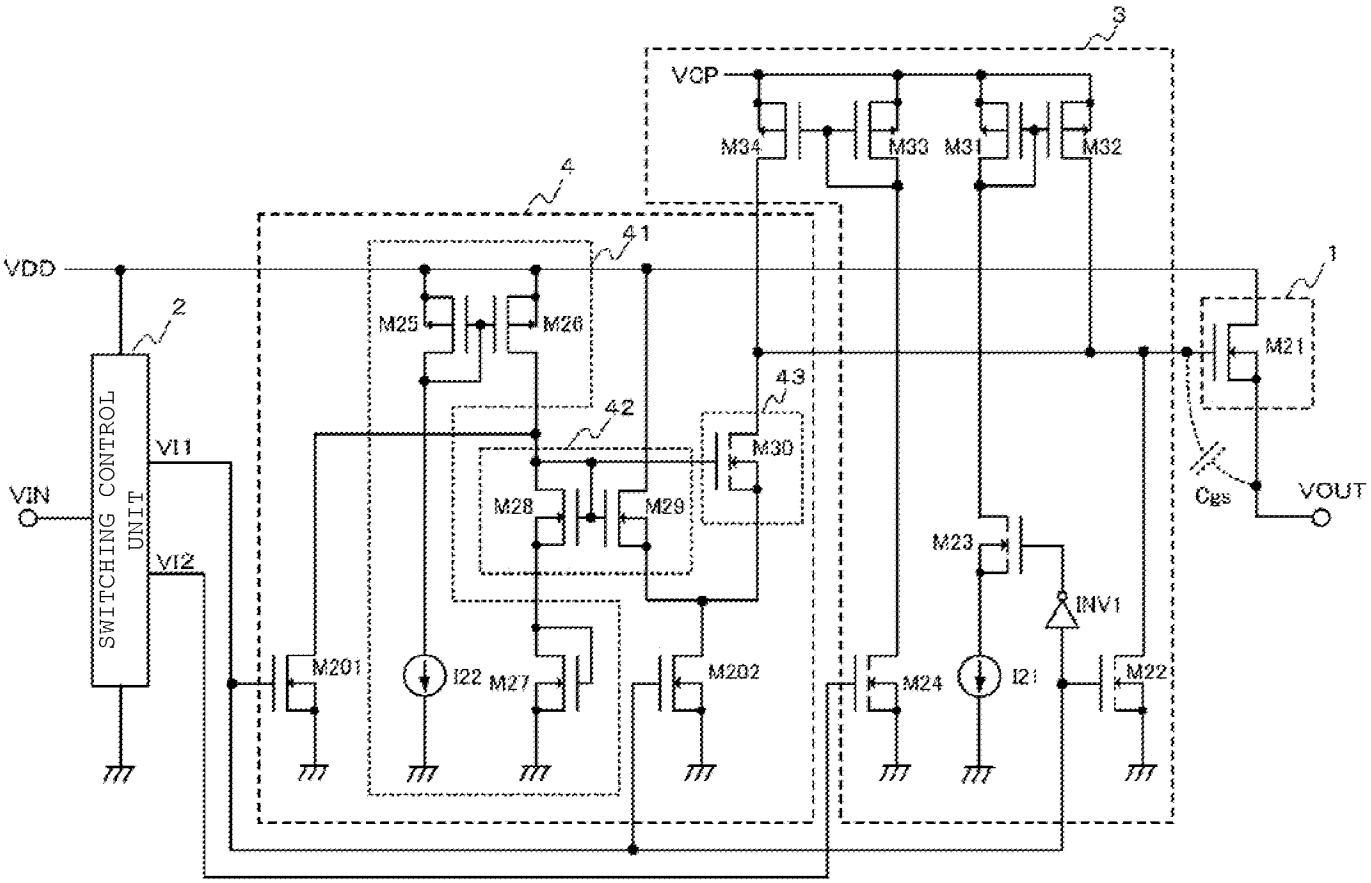
FIG. 5 is a circuit diagram of another specific example of the power supply circuit according to the embodiment.

FIG. 5 illustrates an example of a specific circuit configuration when the load switch 1 is implemented as an NMOS transistor.

In FIG. 5, a NMOS transistor M21 is used as the load switch 1. Since an on-resistance per unit area of the NMOS transistor is lower than that of the PMOS transistor, it is possible to reduce the on-resistance or chip size.

However, since it is necessary to drive the gate potential of the NMOS transistor at a higher potential than the source potential, PMOS transistors M31, M32, M33, and M34 are connected to a high voltage power supply VCP having a higher voltage than the power supply VDD provided in the first control unit 3.

The first control unit 3 includes an NMOS transistor M22 which is connected to the gate terminal of the NMOS transistor M21 and the ground terminal, and the switching control signal VI1 is input to the gate terminal, an NMOS transistor M23 receiving at its gate terminal an inverted signal of the switching control signal VI1 inverted by an inverter INV1, and an NMOS transistor M24 in which the switching control signal VI2 is input to the gate terminal.

In the NMOS transistor M23, a drain terminal is connected to a drain terminal of the PMOS transistor M31, and a source terminal is connected to a constant current source I21. In addition, the PMOS transistor M31 and a drain terminal of the PMOS transistor M32 which configures a current mirror circuit are connected to the gate terminal of the NMOS transistor M21.

In the NMOS transistor M24, the drain terminal is connected to a drain terminal of the PMOS transistor M33, and the source terminal is connected to a ground terminal. In addition, a PMOS transistor M33 and a drain terminal of a PMOS transistor M34 which configures a current mirror circuit are connected to the gate terminal of the NMOS transistor M21.

The second control unit 4 has reversed conductivity types of the MOS transistor of the circuit in FIG. 3, respectively, and changes power supply polarities corresponding thereto. In this case, a gate-source voltage Vgs (M27) of the NMOS transistor M27, which is the same conductivity type as the load switch 1, provides the reference voltage Vref.

In addition, here, high-breakdown voltage elements are used in the NMOS transistors M22, M23, M24, and M30 to which the high voltage power supply VCP is applied.

According to the above described embodiment, when the load switch is switched from OFF to ON, it is possible to cause the gate-source voltage Vgs of the MOS transistor, which is used as the load switch, to be rapidly changed to the threshold voltage Vth using the second control unit. In this manner, it is possible to make rising of the output voltage VOUT start early, even when the output voltage VOUT is controlled so as to slowly rise.

In addition, it is possible to make temperature dependence of the output delay time td small by setting the type of the MOS transistor which is used in the load switch 1 and to be the same type as the MOS transistor which provides the reference voltage Vref.

In addition, it is possible to adjust a value of the output delay time td by adjusting a dimension of the MOS transistor which provides the reference voltage Vref.

According to the power supply circuit in the above described embodiment, it is possible to make rising of the output voltage start early, even when the control voltage of the load switch is slowly changed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A power supply circuit, comprising:

a load switch configured to switch between an ON state connecting the power supply to a load and an OFF state disconnecting the power supply from the load;

a switching control unit configured to output a first signal for controlling switching of the load switch between the ON and OFF states;

a first control unit configured to increase an output voltage of the load switch in a steady manner over a predetermined period of time when the load switch is switched to the ON state in response to the first signal; and a second control unit configured to adjust a charging current that flows to the load switch after the first signal is output from the switching control unit, wherein the second control unit includes:

a reference voltage generation circuit configured to generate a reference voltage, a comparator configured to compare the reference voltage and a first voltage that is applied to a control input of the load switch, and a charging circuit that is controlled by an output signal of the comparator, the charging circuit configured to cause the charging current to flow to the load switch in accordance with the output signal of the comparator.

2. The power supply circuit according to claim 1, wherein the load switch is a first MOS transistor having a gate, a source, and a drain, the drain being connected to the load, the load switch having a parasitic capacitance between the gate and the source of the first MOS transistor, and the first voltage is a gate-source voltage of the first MOS transistor, and the charging circuit causes the charging current to flow to the gate of the first MOS transistor in accordance with the output signal of the comparator.

3. The power supply circuit according to claim 2, wherein the charging circuit generates the charging current until the gate-source voltage of the first MOS transistor reaches the reference voltage.

4. The power supply circuit according to claim 3, wherein the reference voltage generation circuit includes a second MOS transistor having a conductivity type that is the same as a conductivity type of the first MOS transistor, and the reference voltage is the same as a threshold voltage of the first MOS transistor, and the charging circuit charges the parasitic capacitance until the gate-source voltage of the first MOS transistor is approximately equal to the threshold voltage of the first MOS transistor.

5. The power supply circuit according to claim 3, wherein the reference voltage generation circuit includes a second MOS transistor, and the first and second MOS transistors are of a same conductivity type.

6. A power supply circuit, comprising:

a load switch configured to supply power to a load circuit from a power supply according to a control voltage applied to a control input of the load switch;

a second control unit configured to receive a switching control signal and supply a charging current to the control input until the control voltage equals a threshold voltage of the load switch;

a first control unit configured to invert the switching control signal and supply an inverted switching control signal to the control input of the load switch after the control voltage exceeds the threshold voltage; and a switching control unit configured to receive an input signal and generate the switching control signal in response to the input signal, wherein the second control circuit includes:

a reference voltage generation circuit that provides a reference voltage;

a comparator that compares the reference voltage and the control voltage; and a charging circuit that supplies current to the control input of the load switch when an output from the comparator indicates the control voltage is less than the reference voltage.

7. The power supply circuit according to claim 6, wherein the reference voltage is substantially equal to the threshold voltage of the load switch.

8. The power supply circuit according to claim 6, wherein the charging circuit stops supplying current to control input of the load switch when the output from the comparator indicates that the control voltage is equal to or greater than the reference voltage.

9. The power supply circuit according to claim 6, wherein the second control unit includes a clamp circuit configured to disable the comparator when the switching control signal has a state that turns off the load switch.

10. The power supply circuit according to claim 6, wherein the load switch includes a first MOS transistor, and the reference voltage generation circuit includes a reference transistor that includes a second MOS transistor that is of a same type as the first MOS transistor, the reference transistor having a gate to source voltage that is the reference voltage.

11. The power supply circuit according to claim 6, wherein the first control circuit includes:

a current source between a first node and ground; and a pair of transistors each having a drain, a source, and a gate, the pair of transistors being arranged in an inverter configuration connected between the power supply and the first node, and the drains of the transistors being coupled to the second control unit and the gates of the transistors configured to receive the switching signal.

12. The power supply circuit according to claim 6, wherein the load switch is a PMOS transistor and the parasitic capacitance is a gate to source capacitance of the PMOS transistor.

13. The power supply circuit according to claim 6, wherein the power supply supplies power at a power supply voltage, the first control circuit further includes a clamp circuit configured to maintain the load switch in an on state when the clamp circuit is activated; and the switching control circuit is configured to provide a latching signal to the clamp circuit after the voltage on the load circuit has risen to the power supply voltage.

14. A method of operating a load switch connected between a power supply and a load, the method comprising:

outputting, from a switching control unit, a first signal for controlling switching of a load switch between an ON state connecting the power supply to the load and an OFF state disconnecting the power supply from the load;

causing a charging current to flow to the load switch after the first signal switching the load switch to the ON state is output from the switching control unit; and increasing an output voltage of the load switch in a steady manner over a predetermined period of time when the load switch is switched to the ON state in response to the first signal, wherein the load switch is a first MOS transistor and a parasitic capacitance is a gate-to-source capacitance of the first MOS transistor which is charged by the charging current, and charging of the parasitic capacitance ends when a control voltage of the load switch reaches a threshold voltage of the load switch.

15. The method according to claim 14, wherein a reference voltage is set by a second MOS transistor which is a same type as the first MOS transistor.

16. The method according to claim 15, further comprising:

adjusting a size of the second MOS transistor to change a time required to reach the threshold voltage.

17. The method according to claim 14, further comprising:

latching the load switch on after the output voltage of the load circuit reaches a predetermined voltage.

* * * * *